US007757516B1

(12) United States Patent
Starbuck

(10) Patent No.: US 7,757,516 B1
(45) Date of Patent: Jul. 20, 2010

(54) ABRASIVE KNITTING NEEDLE AND SINKER

(75) Inventor: Michael Starbuck, Earl Shilton (GB)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

(21) Appl. No.: 12/402,088

(22) Filed: Mar. 11, 2009

Related U.S. Application Data

(63) Continuation-in-part of application No. 11/485,514, filed on Jul. 12, 2006, now Pat. No. 7,634,922.

(60) Provisional application No. 60/738,482, filed on Nov. 21, 2005.

(51) Int. Cl.
*D04B 35/04* (2006.01)
*D04B 15/06* (2006.01)

(52) U.S. Cl. ..... 66/104; 66/121; 66/123

(58) Field of Classification Search ..... 66/116–123, 66/91, 104
See application file for complete search history.

(56) References Cited

U.S. PATENT DOCUMENTS 2,188,125 A 1/1940 Wigley
2,364,649 A 12/1944 Palliser
3,940,917 A 3/1976 Strachan
5,090,218 A 2/1992 Schuler et al.
5,205,140 A 4/1993 Nielsen et al.
5,205,644 A 4/1993 Bayer et al.
5,239,844 A 8/1993 Sos
5,916,273 A 6/1999 Hepfinger
6,242,370 B1 6/2001 Dischler
6,298,692 B1 10/2001 Kuroda et al.

*Primary Examiner*—Danny Worrell
(74) *Attorney, Agent, or Firm*—Womble Carlyle Sandridge & Rice, PLLC

(57) ABSTRACT

A fabric can be formed by a process comprising providing a knitting needle and providing a sinker. The sinker can include a first end and a nib. The first end and the nib can form a groove for receiving a yarn. The first end in or near the groove can have a first abrasive surface for abrading the yarn during knitting. A knitting needle can have a shank with a first edge and a hook. The knitting needle can have a latch having an outer region. At least a portion of the first edge and at least a portion of the outer region can have a second abrasive surface for abrading a yarn during knitting.

4 Claims, 6 Drawing Sheets

ABRASIVE KNITTING NEEDLE AND SINKER

CROSS REFERENCE TO RELATED APPLICATIONS

This application is a continuation-in-part application of U.S. application Ser. No. 11/485,514, filed Jul. 12, 2006, now U.S. Pat. No. 7,634,922, which claims the benefit of U.S. Application Ser. No. 60/738,482, filed Nov. 21, 2005.

FIELD OF THE INVENTION

The present invention is related to knitted fabrics. More particularly, the present invention is related to an improved knit sueded fabric formed with novel knitting needles and sinkers.

BACKGROUND

Fabric softness, hand, drape, and appearance continue to influence consumer demand for apparel products. Fabric hairiness is one attribute of a fabric that has some correlation to softness, hand and appearance of the fabric. For example, a fabric with a higher hairiness value is generally associated with a perceived soft hand and supple fabric. Hairiness refers to the amount of fibers and/or fibers ends protruding from the surface of the fabric. While improved softness is associated with higher hairiness values, so are higher pilling rates, or pill counts. Thus, the designer is tasked to minimize these negative effects of increased hairiness.

Fiber, yarn and finishing process selection allows designers to influence the hairiness of fabrics and balance softness and pilling rates. Ring spun and open end yarns are two yarns, among others, that are used to manufacture knit fabrics for apparel. Structural differences between these yarns yield fabrics with different surface characteristics. For example, ring spun yarns typically have fiber ends emanating from the yarn. Open ends yarns, however, typically have fibers wrapped around a core bundle of fibers. Thus, fabrics manufactured with ring spun yarns, i.e., ring spun fabrics, can have higher hairiness values and are typically softer than fabrics manufactured with open end yarns. Consumers continue to desire ring spun fabric qualities in apparel such as T-shirts and underwear. Knit manufacturers, however, can realize increased cost savings and decreased manufacturing complexity using open end yarns.

Several finishing processes can be used to impart ring spun fabric qualities to knit fabrics produced from open-end or other types of yarns. One such process abrades a fabric to cut and raise the surface of the yarns. This process, known as sueding, yields a raised nap producing a soft, smooth surface texture resembling suede leather.

Sueding has several disadvantages such as the additional processing steps required, and the inefficiencies related to width utilization and increased fabric costs. Generation of lint, fly, and abrasive dust during processing raises environmental concerns for machine operators. Streaks in the fabric, reduction in strength, and shade changes during dying are other disadvantages associated with sueding.

Thus, there is a need for a knit fabric and a method of knitting fabrics having improved surface characteristics and softness, reduced pilling rates, lower costs and decreased manufacturing complexity.

DETAILED DESCRIPTION

Certain exemplary embodiments of the present invention are described below and illustrated in the accompanying Figures. The embodiments described are only for purposes of illustrating embodiments of the present invention and should not be interpreted as limiting the scope of the invention. Other embodiments of the invention, and certain modifications and improvements of the described embodiments, will occur to those of skill in the art, and all such alternate embodiments, modifications and improvements are within the scope of the present invention.

A knit fabric can be formed using a needle and a sinker having abrasive surfaces. A needle and sinker can abrade a yarn during knitting to yield a fabric with improved softness and hand.

Figure 1:
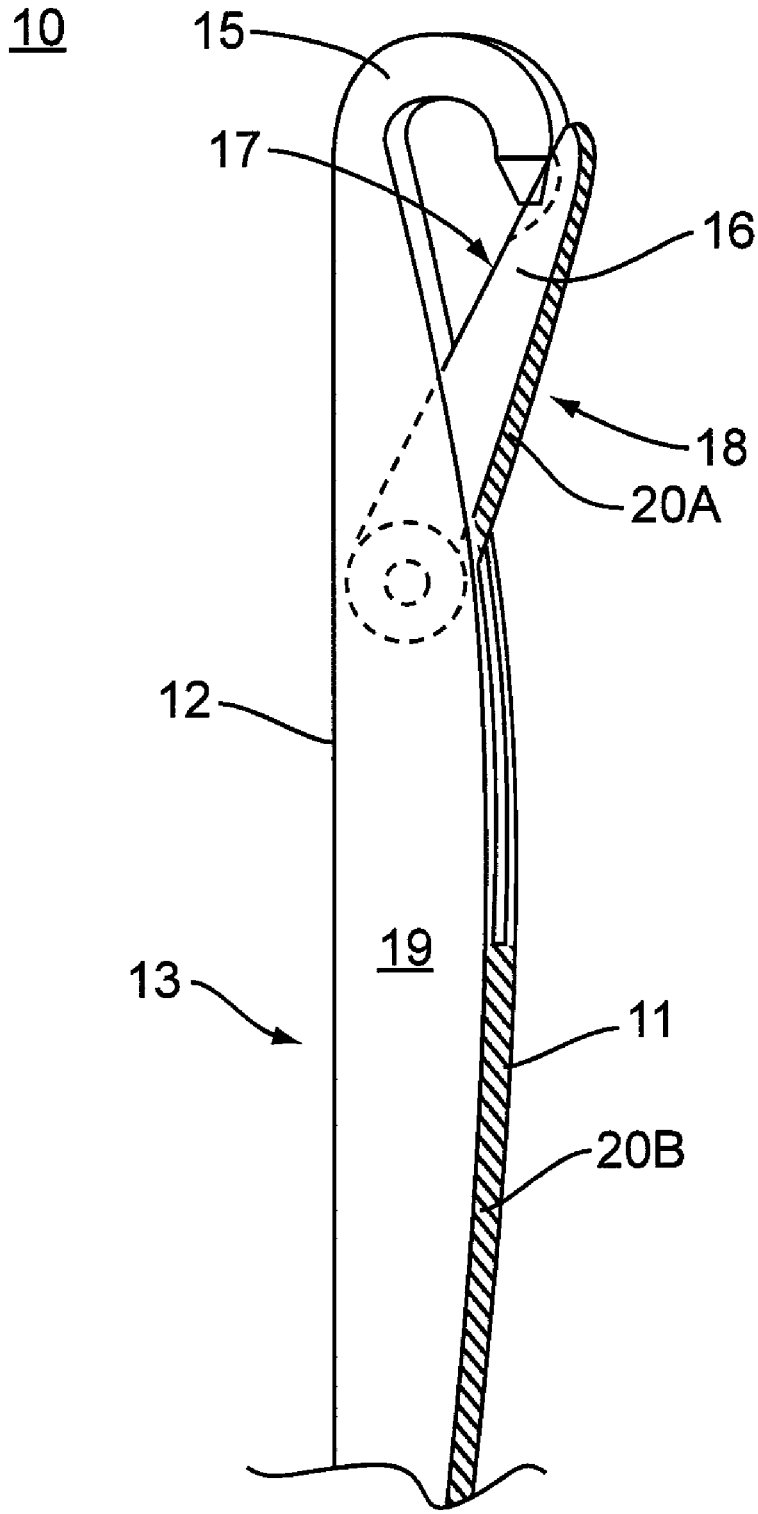
FIG. 1 shows side perspective view of an improved needle.

FIG. 1 shows a needle 10 having a shank 13, a hook 15, and a latch 16 operably connected to a shank 13. The shank 13 may have opposing first and second edges 11 and 12, respectively. The latch 16 may pivot within the shank 13 and extends outwardly from the first edge 11. First and second edges 11 and 12 are generally orthogonal to sides 19, as shown. In alternate embodiments, first edge 11 and second edge 12 may be convex or rounded. The latch 16 may have a smooth or rounded inner region 17. Needle 10 may be used to form a yarn into a plurality of loops, as is known in the art.

Needle 10 has abrasive surfaces 20A and 20B capable of abrading a yarn during formation of a loop. Abrading, as used herein, refers to causing the fibers and/or fiber ends to protrude from a yarn, loop or fabric. As shown in FIG. 1, the abrasive surfaces 20A and 20B may comprise at least a portion of the first edge 11 and the outer region 18. In alternate embodiments, the abrasive surfaces 20A and 20B may comprise first edge 11 and only a portion of the outer region 18. In other alternate embodiments, however, the abrasive surfaces may overlap a portion of the sides 19.

Figure 2:
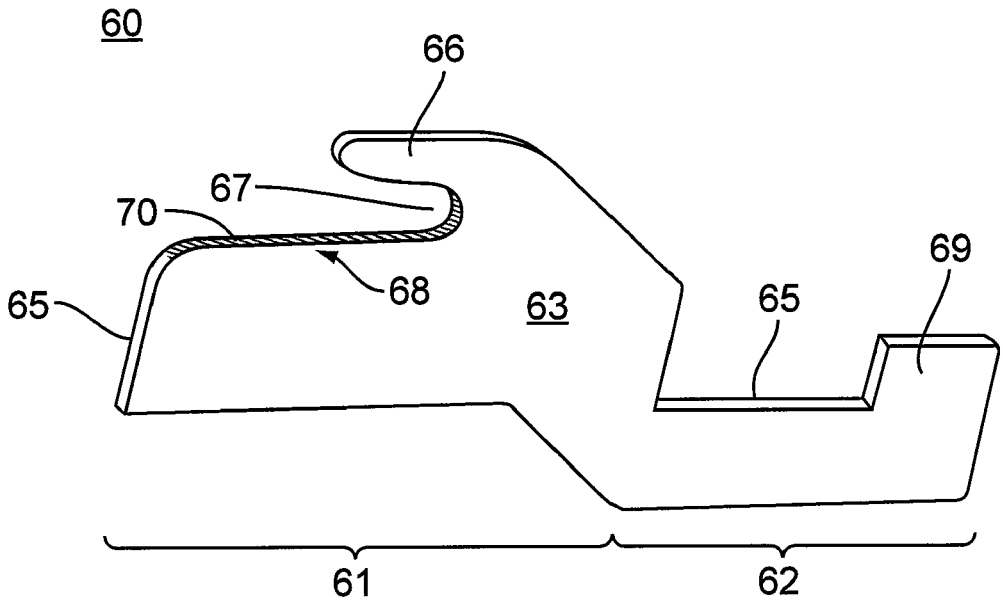
FIG. 2 shows a top perspective view of an improved sinker.

Turning to FIG. 2, the improved sinker 60 is shown, which cooperates with the needle 10 to receive and abrade a yarn 30 during knitting. As shown in FIG. 2, the sinker 60 has a first end 61 and a second end 62, opposing sides 63 and 64 (not shown), and an edge 65. The sinker 60 may also be referred to as a holding-down sinker as is known in the art. Edge 65 is also referred to herein as the sinker edge. While one embodiment of the sinker 60 is shown in FIG. 2, the sinker 60 may have any profile, depending on the type of knitting machine used, as is known in the art. The edge 65 may form the periphery of the sinker 60 and have a flat surface orthogonal to sides 63, as shown. In alternate embodiments, however, edge 65 may be convex or rounded.

Figure 5:
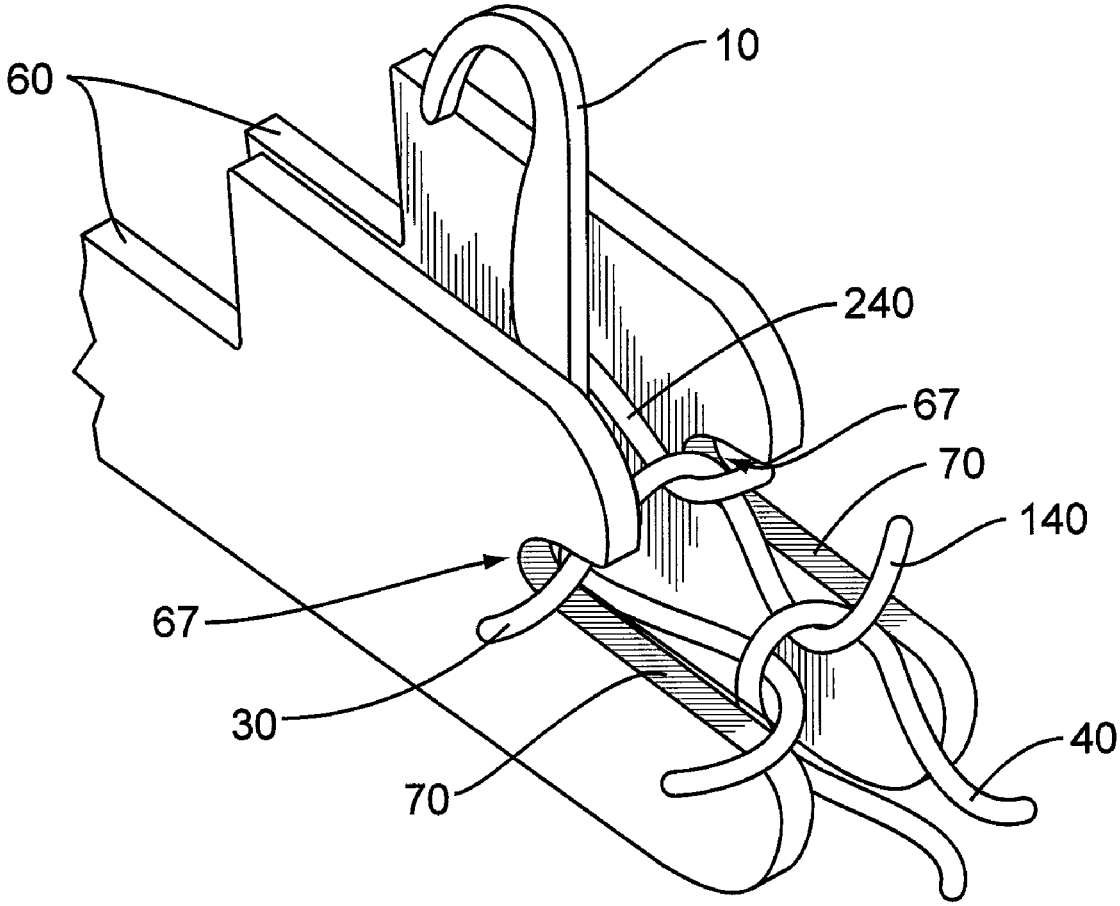
FIG. 5 shows a top perspective view of a set sinkers and a needle.

The first end 61 of the sinker 60 receives and engages yarn 30 and loop 40 (not shown). Sinker 60 has a nib 66 extending above and over a knitting platform 68 to form a groove 67 or throat of the sinker 60, as is known in the art. The throat 67 receives the yarn 30 as shown in FIG. 5. An abrasive surface 70 is formed on the edge 65 proximate the knitting platform 68 and grove 67, as shown FIGS. 2 and 5. This abrasive surface 70 also abrades the yarn 30 and/or loop 40 during knitting. In alternate embodiments, edge 65 and portions of sides 63 and 64 proximate edge 65 may have abrasive surfaces.

In alternate embodiments, the sinker 60 may have a plurality of grooves. For example, a second nib and a second knitting platform may form a second groove. Each additional groove and knitting platform also may have abrasive surfaces. Multiple groove embodiments of sinker 60 may be used for plush or pile knit fabrics, as are known in the art. For example, plush, or pile fabrics may be formed with loop forming sinkers, or holding-down/loop forming sinkers, as is known in the art.

The second end 62 of the sinker 60 facilitates movement of the sinker 60. A control butt 69 on the second end 62 engages the sinker cam 158 (see FIG. 4A). The sinker cam 158 moves the sinker 60 in first and second directions 161 and 162 across the needle 10.

Abrasive surfaces 20 and 70 have a predetermined surface roughness capable of abrading a yarn and/or a loop. The predetermined surface roughness depends on, among other things, the desired hand feel of the resultant fabric, processing conditions during knitting, and the type of yarn used. Mechanical processes, chemical compositions, and/or the formation process used to manufacture the needle and sinker may be employed to form the abrasive surfaces 20 and 70. For example, needle 10 may be knurled, scuffing, filed, grooved or otherwise treated to a predetermined surface roughness. Also, the abrasive surfaces may be etched by a laser, or impacted by or during the stamping, cutting or shaping of the needle 10 and/or the sinker 60.

With respect to chemical compositions, a coating may be applied to the needle 10, yielding a predetermined surface roughness. In alternate embodiments, a coating may be used in combination with a silica and deposited on the needle 10. Further, processes such as chemical vapor deposition may be used to impart a predetermined surface roughness to needle 10 and/or sinker 60.

Abrasive surfaces 20 and 70 are sufficient to abrade the yarn 30 during knitting, without severing or excessively weakening the yarn. For example, abrasive surfaces 20 and 70 have a negligible impact on the fault rate of knitting. Fault rate, as used herein, refers to the number of yarn breaks, needle breaks, or missed stitches per linear yard of fabric. For example, an acceptable fault rate can be observed when open end yarns are used with the needle 10 and sinker 60.

The needle 10 and sinker 60 may be used on circular knitting machines, including open top, dial, cylinder, or cylinder-and-dial machines. Further, the needle 10 and sinker 60 may be used on straight bar machines or flat knitting machines. In alternate embodiments, abrasive surfaces may be use with warp knitting machines that uses latch needles.

Figure 3:
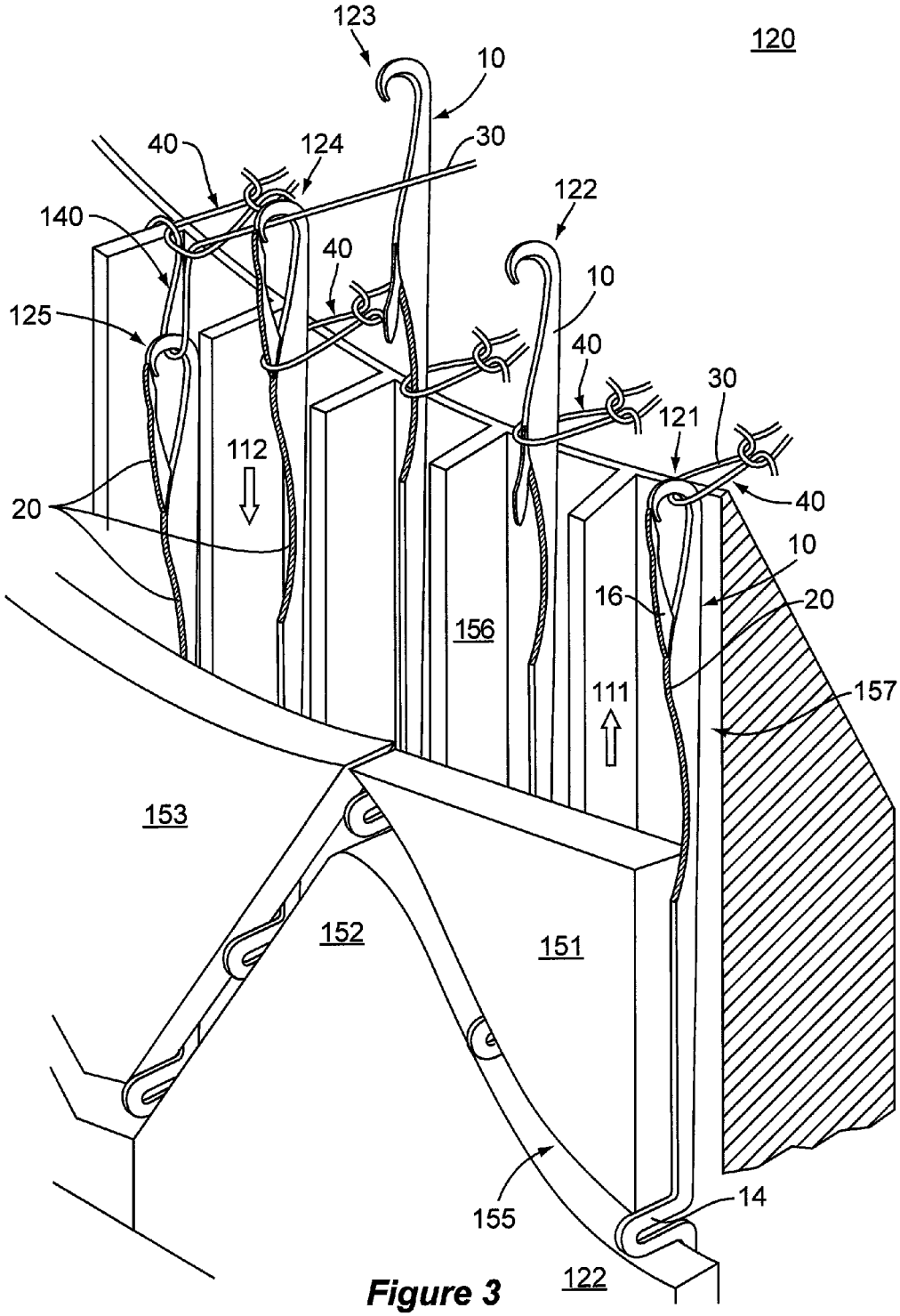
FIG. 3 shows a top perspective view of a knitting machine cut away to show various positions of the needle during a knitting cycle.

FIG. 3 illustrates the use of abrasive surfaces 20 during the knitting cycle 120 of a circular knitting machine (the sinkers are not shown in FIG. 3 for illustrative purposes). A circular knitting machine can have a trick wall 156 and channels 157 that house needles 10. A guard cam 151, clearing cam 152, and stitch cam 153 form a path 155 through which needle butt 14 travels. Movement of the needle 10 up in a first direction 111, or down in a second direction 112 within channel 157 depends on the position of needle butt 14 in path 155. Path 155 thus corresponds to the stages of the knitting cycle 120 that include a ground position 121, tuck height position 122, yarn feeding and clearing position 123, cast off position 124, and knock over position 125.

FIG. 3 shows a knitted loop 40 enclosed in hook 15 and latch 16 at ground position 121. The needle 10 moves up channel 157 in the first direction 111 towards the tuck height position 122. The loop 40 opens latch 16 as the needle 10 approaches and arrives at tuck height position 122.

The loop 40 clears latch 16 at the clearing height position 123. As needle 10 approaches the clearing height position 123, the abrasive surface 20 engages the yarn 30. While the sinker 60 is receiving the loop 40, the yarn feeder 159 introduces the yarn 30 (see FIG. 4C) to a hook 15 at the clearing height position 123.

It is recognized that the abrasive surface 20 may delay opening of the latch 16 as the needle 10 approaches the clearing height position 123. The delayed opening can result in missed loops and an increased fault rate. Thus, the position of yarn feeder 159 may be adjusted closer to, or further away from, needle 10 as the need may arise. Further, yarn tension in the positive feed system may be adjusted to minimize missed loops resulting from delayed latch opening. In other alternate embodiments, a soluble needle oil may be used to improve the opening of latch 16.

FIG. 3 illustrates how the needle 10 at the cast off 124 and knock over 125 positions forms a new loop 140 and abrades loop 40. The loop 40 moves over abrasive surface 20 as the needle 10 moves downwards in the second direction 112 toward cast off position 124. Hence, the loop 40 is cast off into the fabric by sinker 60 (not shown). The needle 10 continues downwardly toward knock over position 125, pulling the loop 40 over the abrasive surface 20 and forming a new loop 140.

Figure 4A:
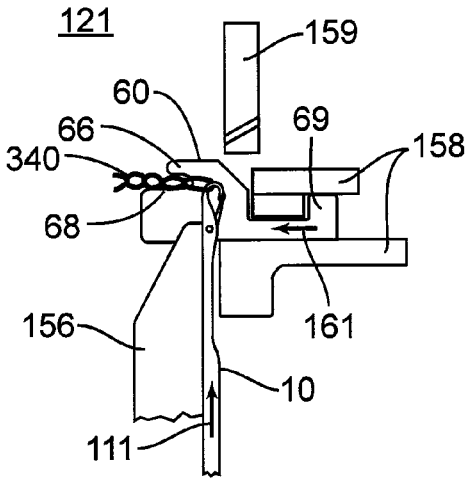
FIGS. 4A through 4E show side views of the improved needle and sinker during a knitting cycle.
Figure 4B:
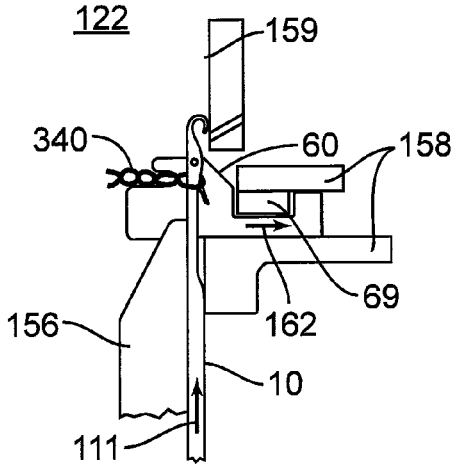

The sinker 60 abrades the yarn 30 and loop 40 during the knitting cycle 120, as shown in FIGS. 4A through 4E. The sinker cam 158 engages control butt 69, moving the sinker 60 in a first direction 161 toward needle 10. FIG. 4A illustrates the needle 10 at the ground position 121 with the sinker 60 supporting previously formed loops 340. As the needle 10 moves up in the first direction 111 toward the tuck height position 122, the sinker 60 retracts in the second direction 162 via operation of the sinker cam 158, as shown in FIG. 4B. Thus, groove 67 (not shown), nib 66, and knitting platform 68 hold, cast off, and abrade the previously formed loops 340.

Figure 4C:
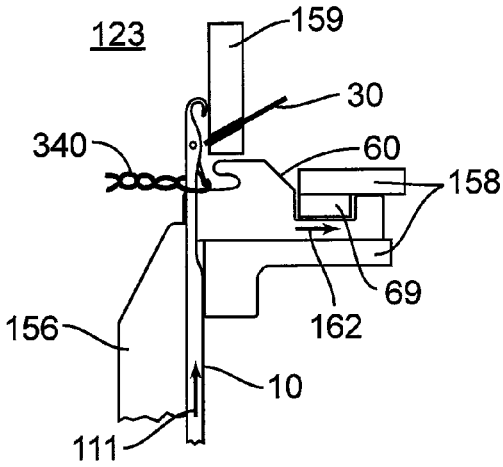
Figure 4D:
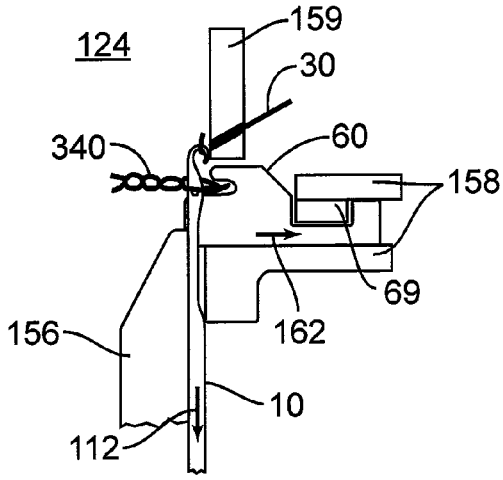
Figure 4E:
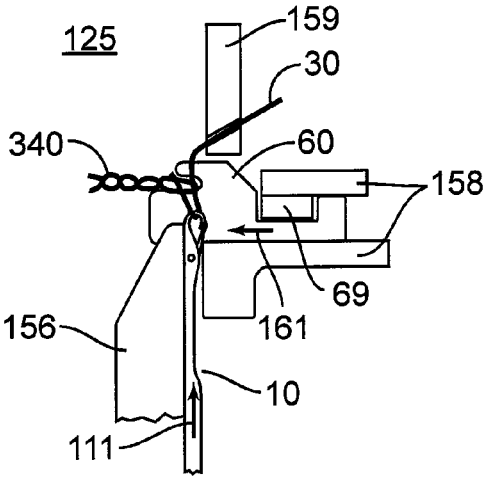

FIG. 4C illustrates the needle 10 at clearing position 123 with the sinker 60 retracted. As the needle 10 moves downwardly within its channel 157 (not shown), the loop crosses abrasive surface 20 (also not shown) as described above. The sinker 60 moves across the needle 10, casting off previously formed loops 340 at the knock over position 125. During the movement of sinker 60 across the needle 10, the abrasive surface 70 abrades previously formed loops 340.

FIG. 5 illustrates a set of sinkers 60 positioned near opposing sides of a needle 10. As the sinkers 60 move across the needle 10, the loops 40, 140, and 240 are abraded by the abrasive surfaces 70 on the sinkers 60. Spreader rolls (not shown) under the needle and sinker dial may minimize variations in tension as the loops are cast off into the fabric. Circular knitting machines form a tube of fabric that is wound into a roll with the spreader rolls. The fabric tube is opened up between where the loops are cast off into the fabric and where with the spreader rolls close the fabric to form the fabric roll. This opening process helps create steady and even tension in the fabric. As yarn feeder tension adjustments are made, the position of spreader rolls can be adjusted, as the need may arise.

A knit fabric suitable for T-shirts, undergarments, socks, sweatshirts, tank tops, and brassieres, among others, may be manufactured using the needle 10 and sinker 60 described herein. The knit fabric may be a single jersey fabric, or in alternate embodiments, the knit fabric may be a double jersey, interlock, ribbed, jacquard single or jacquard double jersey, or other weft-knitted fabric. In other alternate embodiments, the knit fabric can be formed with a warp knitting process that uses latch needles.

The knit fabric may comprise natural or synthetic fibers. The fibers may be cotton, rayon, polyester, polypropylene, polyamide 6 or polyamide 6,6, wool, acrylic, elastane or other elastomeric fiber, or combinations thereof. In alternate embodiments, bi-component fibers may be used, such as sheath-core, side by side, tri-lobal tipped, or islands in the sea. In other alternate embodiments, the yarns 30 may be formed from blends of fibers. For example, an intimate blend of cotton and polyester may be used to form yarn 30.

A variety of other yarns also may be used to formed the knit fabric. For example, yarn 30 may be a staple yarn, continuous filament yarn, plied yarn, or combinations thereof. Further, yarn 30 may be open end, ring spun, air jet spun, rotor spun, or a core-spun yarn. For example, a core spun yarn with an elastic core can be used to form the knit fabric. In an embodiment, yarn 30 may have a cotton count (cc) between about 5/1 and about 75/1, more preferably between about 20/1 and 35/1.

Three exemplary fabrics were knitted according to the process described above using the improved needle and sinker and there resultant hairiness evaluated. Example A comprised a single jersey knitted fabric. An open-end yarn having a cotton count of 26/1 spun from cotton fibers was used. Needles and sinkers having abrasive surfaces 20 and 70, as described above, were used to manufacture Example A. A coating was used to form abrasive surfaces 20 and 70. Comparative examples were manufactured with an open end yarn (Example B) and a ring spun yarn (Example C), both using conventional needles and sinkers, i.e., without abrasive surfaces.

Figure 6:
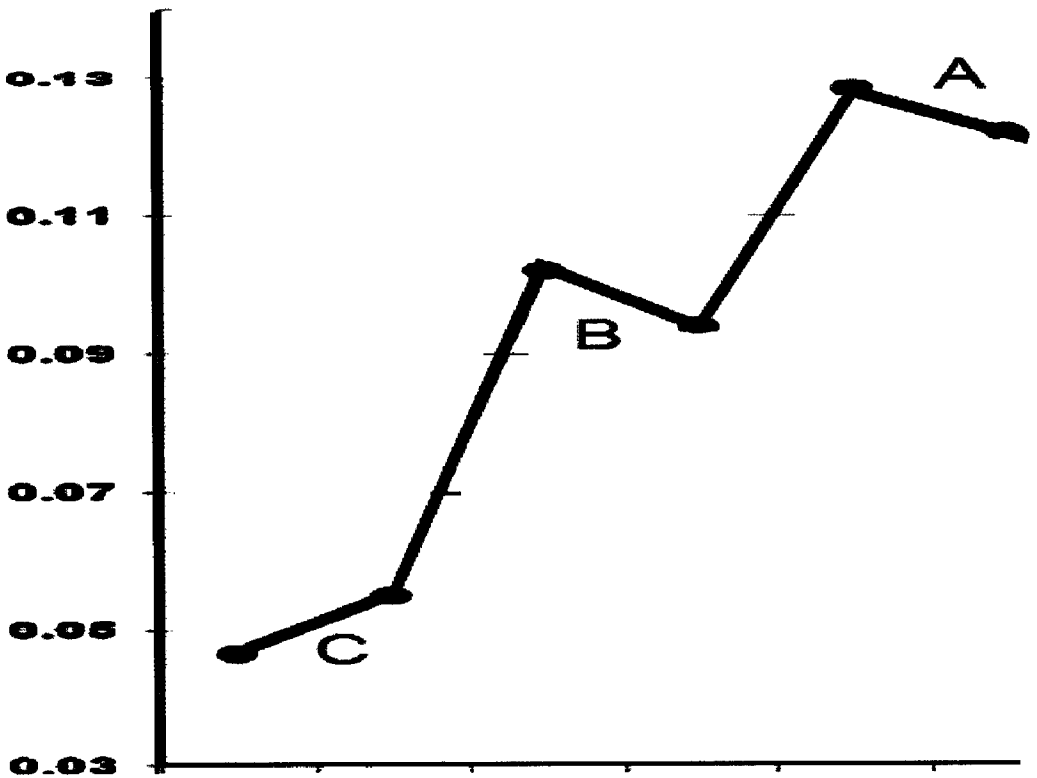
FIG. 6 graphically illustrates the effect of the improved needle and a sinker on fabric hairiness.

Examples A, B and C were tested for hairiness. Samples of each fabric were cut to 50-cm squares. Each sample was passed over an infrared light that counts the number, height and density of protruding fiber ends on the surface of a fabric. These values were then used to calculate a hairiness index. Each side of the sample was tested in the course direction, the wale direction, and each bias direction, i.e., the bias forms a line at about a 45° angle with the course direction and another line at about 45° angle with the wale direction of a fabric. Data from both sides of the fabric are shown in FIG. 6. Example A yields a higher hairiness index for both sides of the fabric compared to examples B and C. As an unexpected result, Example A formed from an open-end yarns, had a higher hairiness index than a similar structure manufactured from ring spun yarns.

The above descriptions of various embodiments of the invention are intended to describe and illustrate various elements and aspects of the invention. Persons of ordinary skill in the art will recognize that certain changes and modifications can be made to the described embodiments without departing from the scope of the invention. All such changes and modifications are intended to be within the scope of the appended claims.

What is claimed is:

1. A needle and a sinker for use in a knitting machine,
the sinker comprising,
a first end having a nib,
the first end and the nib forming a groove for receiving a yarn, and having a first abrasive surface for abrading the yarn during knitting,
the knitting needle comprising,
a shank having a first edge,
a hook on the shank, and
a latch having an outer region.

2. The needle and sinker of claim 1, wherein at least a portion of the first edge and at least a portion of the outer region have a second abrasive surface for abrading the yarn during knitting.

3. The needle and sinker of claim 1, wherein the first abrasive surface is formed using a coating.

4. The needle and sinker of claim 2, wherein the second abrasive surface is formed using a coating.

* * * * *